US010222052B1

(12) United States Patent
Ter-Hovhannisyan

(10) Patent No.: US 10,222,052 B1
(45) Date of Patent: Mar. 5, 2019

(54) LINEAR LED LIGHTING FIXTURE

(71) Applicant: LIGHT EMITTING DESIGN, INC., Burbank, CA (US)

(72) Inventor: Zorak Ter-Hovhannisyan, Burbank, CA (US)

(73) Assignee: LIGHT EMITTING DESIGN, INC., Burbank, CA (US)

( * ) Notice: Subject to any disclaimer, the term of this patent is extended or adjusted under 35 U.S.C. 154(b) by 0 days.

(21) Appl. No.: 15/717,120

(22) Filed: Sep. 27, 2017

(51) Int. Cl.

| | |
|---|---|
| ***F21V 31/00*** | (2006.01) |
| ***F21K 9/272*** | (2016.01) |
| ***F21V 23/00*** | (2015.01) |
| ***F21V 29/508*** | (2015.01) |
| ***F21V 19/00*** | (2006.01) |
| ***F21V 21/005*** | (2006.01) |
| ***F21S 8/04*** | (2006.01) |
| ***F21V 23/04*** | (2006.01) |
| *F21Y 115/10* | (2016.01) |
| *F21V 3/02* | (2006.01) |
| *F21Y 103/10* | (2016.01) |

(52) U.S. Cl.
CPC ..... *F21V 31/005* (2013.01); *F21K 9/272* (2016.08); *F21S 8/043* (2013.01); *F21V 19/003* (2013.01); *F21V 21/005* (2013.01); *F21V 23/002* (2013.01); *F21V 23/009* (2013.01); *F21V 23/0471* (2013.01); *F21V 29/508* (2015.01); *F21V 3/02* (2013.01); *F21Y 2103/10* (2016.08); *F21Y 2115/10* (2016.08)

(58) Field of Classification Search
CPC ..... F21V 31/005; F21V 3/02; F21V 29/508; F21V 19/003; F21V 23/009; F21V 21/005; F21V 23/002; F21V 23/0471; F21K 9/272; F21S 8/043; F21Y 2103/10
USPC ..... 362/249.05, 240, 217.1, 217.12, 217.13, 362/158
See application file for complete search history.

(56) References Cited

U.S. PATENT DOCUMENTS

| | | | | |
|---|---|---|---|---|
| 2011/0149576 | A1* | 6/2011 | Hsu | F21V 29/004 362/294 |
| 2012/0099318 | A1* | 4/2012 | Liu | F21S 2/005 362/249.02 |
| 2012/0099319 | A1* | 4/2012 | Liu | F21S 2/005 362/249.02 |
| 2012/0106143 | A1* | 5/2012 | Yeh | F21V 31/005 362/217.05 |
| 2012/0162982 | A1* | 6/2012 | Wang | F21V 15/013 362/235 |
| 2012/0300460 | A1* | 11/2012 | Liu | F21V 19/02 362/249.02 |
| 2017/0101046 | A1* | 4/2017 | Beiwen | B60Q 1/0064 |

* cited by examiner

*Primary Examiner* — Laura Tso
(74) *Attorney, Agent, or Firm* — Kelly & Kelley, LLP

(57) ABSTRACT

A linear LED lighting fixture includes an elongated housing having a plurality of LEDs and a light transmissive cover. An interior end cap is attached to an end of the housing. An exterior end cap is attached to the interior end cap to form a junction box therebetween. Waterproof seals are formed between the housing and the junction box.

19 Claims, 8 Drawing Sheets

LINEAR LED LIGHTING FIXTURE

FIELD OF THE INVENTION

The present invention generally relates to industrial light fixtures. More particularly, the present invention relates to a linear LED lighting fixture having a waterproof junction box formed between two end caps.

BACKGROUND OF THE INVENTION

Industrial lighting fixtures are used in a wide variety of industries. These lighting fixtures are often hung from a ceiling and elongated in nature so as to provide sufficient light to the industrial process or other commercial lighting needs. In the past, such lighting fixtures often used fluorescent lightbulbs which were several feet in length and thus could provide sufficient light to a large area.

For lighting applications, light emitting diodes (LEDs) are particularly energy efficient and tend to have a long operating life. LEDs may be employed in many different basic lighting structures to replace conventional fluorescent lighting. It is well known that such LED light fixtures incorporate not only the light emitting diodes themselves, but also related electronic circuitry components which are necessary to power and operate the LEDs.

Junction boxes are well known and used to join power cords to one another in a safe manner. Such junction boxes are typically attached to or recessed within a ceiling or wall, typically in close spaced relation to the light fixture. However, in some cases, such as when the lighting fixture is suspended from a ceiling or the like, the junction box can be placed a distance from the actual light fixture.

Industrial light fixtures are sometimes used in harsh conditions. For example, in chicken or livestock farming, food processing plants, clean rooms, and parking structures, the lighting fixtures may be subjected to fluid or material as a result of the location and processes occurring therein. At times, the light fixtures must be subjected to high pressure wash downs to clean these facilities completely. Of course, it will be appreciated that any water or fluid exposure to electrical power cords, LEDs or associated electronic circuitry could have deleterious effects on the lighting fixture.

Accordingly there is a continuing need for a linear LED industrial light which is water resistant or waterproof so as to be utilized in locations having harsh conditions. What is also needed is linear LED light having a junction box formed therein so as to be conveniently accessible. A linear LED light is also needed which provides ample lighting to a wide area in an efficient manner. The present invention fulfills these needs, and provides other related advantages.

SUMMARY OF THE INVENTION

The present invention resides in a linear LED light fixture, which is particularly suited for harsh industrial conditions wherein the light fixture may be exposed to fluids or water. The linear LED light of the present invention generally comprises an elongated housing. The housing includes a plurality of LEDs and a light transmissive cover.

A first end of an interior end cap is attached to an end of the housing. A first gasket provides a waterproof seal between the first end of the interior end cap and the housing. The first gasket may comprise an open-face groove that receives the end of the housing therein. The open-faced groove may be defined by elastomeric walls having an inward taper.

An exterior end cap is attached to a second end of the interior end cap. A second gasket provides a waterproof seal between the second end of the interior end cap and the exterior end cap. The interior end cap and the exterior end cap cooperatively form a junction box therebetween having waterproof seals.

A power cord extends through the exterior end cap in a waterproof manner and provides power to the LEDs within the housing. The power cord extends through a waterproof coupling through the exterior end cap and into the junction box.

A heat sink supporting LED electronic circuitry components may extend from the interior end cap into the housing. The housing may define a V-shaped LED support member above the light transmissive cover.

A motion sensor may be operably coupled to the LEDs, such as through the electronic circuitry components. The motion sensor has a waterproof seal with the junction box.

The housing may include an attachment rail along a length of an upper surface thereof. An attachment bracket may be removably coupled to the rail, such as for coupling the light fixture to a supporting or hanging member.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
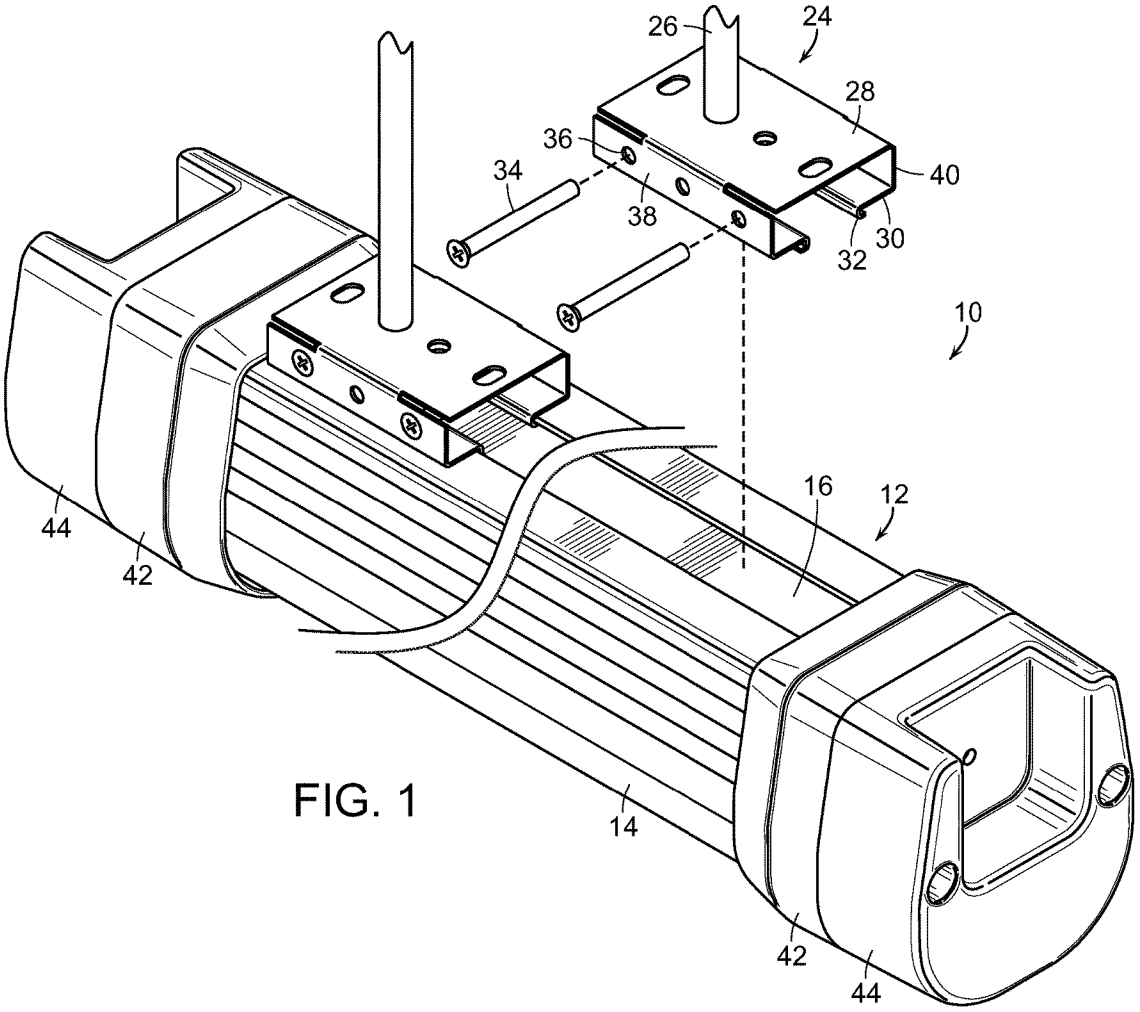
FIG. 1 is a perspective view of a linear LED light fixture and expandable attachment brackets, embodying the present invention.

As shown in the drawings, for purposes of illustration, the present invention resides in a linear LED lighting fixture, generally referred to herein by the reference number 10. The light fixture 10 is designed to withstand harsh conditions in demanding environments, such as those that might require high-pressure wash downs, such as livestock and poultry farming, food processing plants and the like. As such, the light fixture 10 is waterproof so as to protect electrical connections and components therein which could be damaged by exposure to water and other fluids and substances. The light fixture 10 incorporates LED lighting so as to be more cost efficient and provide a high level of light. The light fixture is elongated and easily mountable, or more typically suspended, so as to eliminate a relatively large desired area.

With reference now to FIG. 1, the light 10 includes an elongated housing 12 which houses a plurality of LEDs and related circuitry. A light transmissive cover 14 is attached to the housing 12, typically on an underside portion thereof, which allows the light from the illuminated LEDs to pass therethrough.

Figure 7:
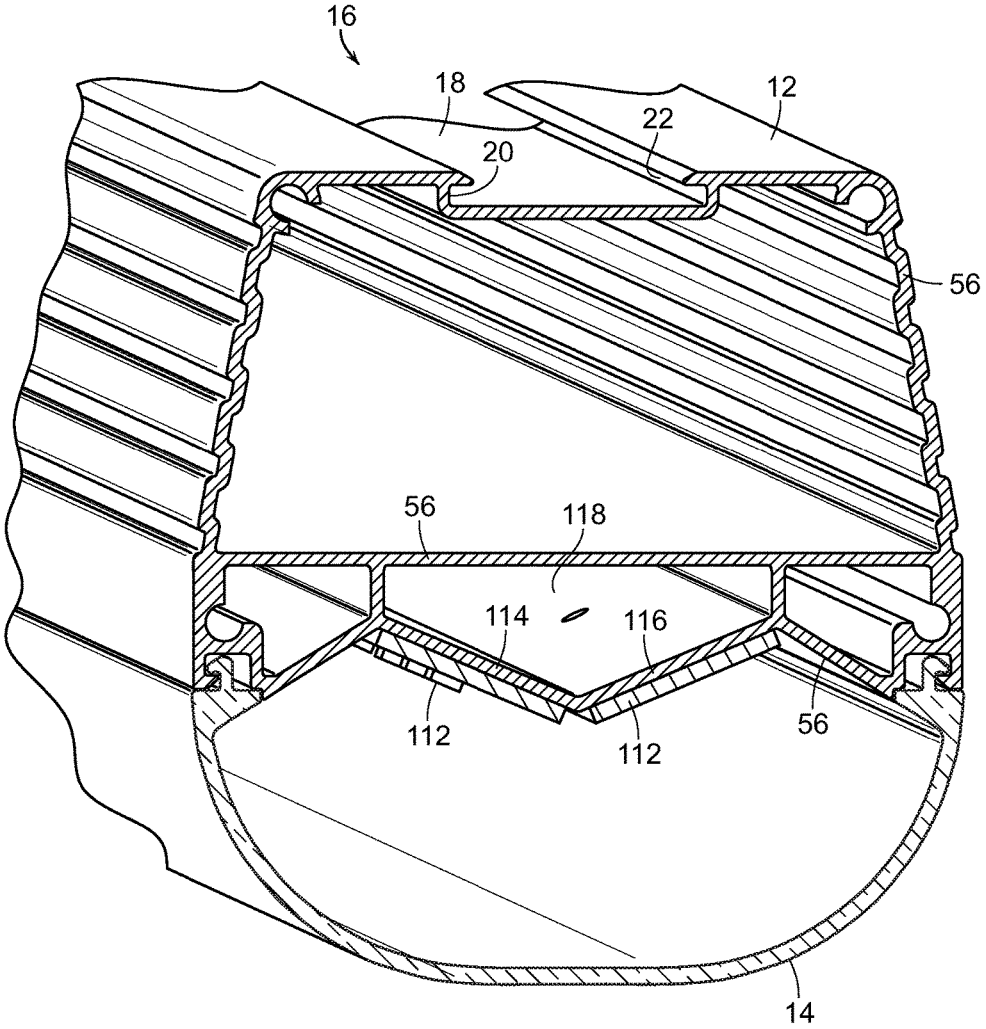
FIG. 7 is a cross-sectional view of a housing of the light fixture of the present invention.

The housing 12, typically an upper surface thereof includes a rail 16 attached thereto or formed therein. With reference to FIG. 7, in one configuration, the rail 16 includes a generally recessed central area 18 defining open-faced grooves 20 and 22 which generally face one another on opposite ends of the recessed area 18. The rail 16 enables the light 10 to be mounted or suspended at a desired location.

With reference again to FIG. 1, attachment brackets 24 may be removably coupled to the rail 16. A cable or chain or the like 26 may extend from the attachment bracket 24 so as to suspend the light fixture 10 at a desired height and location. The attachment bracket 24, as illustrated in FIG. 1, may be generally U-shaped or C-shaped and have a top wall or member 28. The wings 30 include a bent-free end forming a hook 32 which is insertable into the recessed area 18 as the bracket 24 is placed upon the housing 12. In order to attach the bracket 24 to the housing 12, a bolt 34 extends through an aperture 36 of a side wall 38 until it comes into contact with the inner surface of the opposite side wall 40, causing the side walls to move apart from one another and expand the bracket 24 until the hooks 32 are pushed into the grooves 20 and 22 of the rail 16. With the one or more attachment brackets 24 secured to the housing 12, the light fixture 10 can be suspended, or otherwise mounted, in place.

Figure 2:
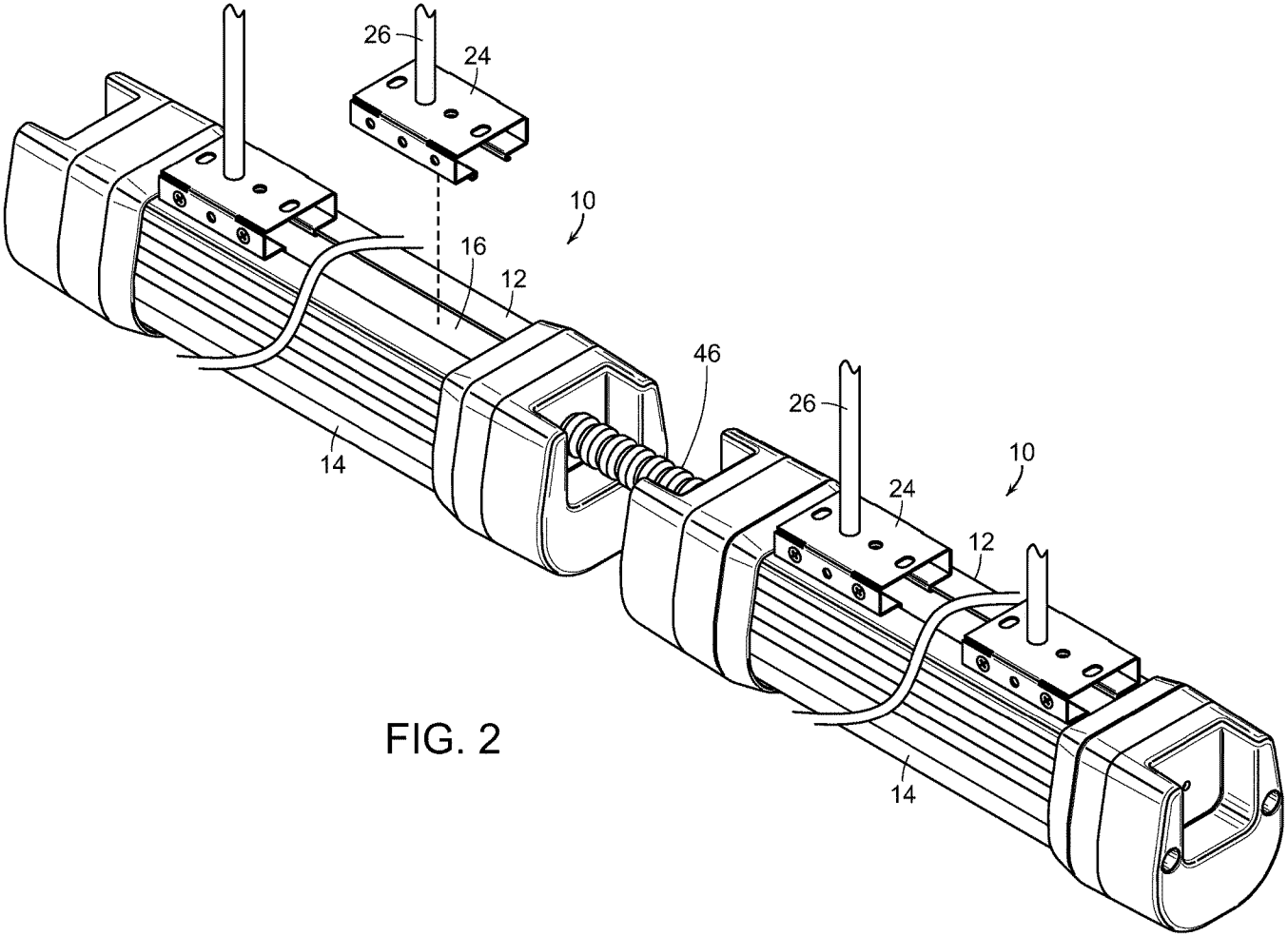
FIG. 2 is a perspective view of two linear LED light fixtures connected to one another in a daisy-chain fashion, in accordance with the present invention.

With continuing reference to FIG. 1, an interior end cap 42 is attached to each end of the housing 12. An exterior end cap 44 is attached to an outer or second end of the interior end cap 42. As will be more fully discussed herein, the interior and exterior caps 42 and 44 cooperatively form a waterproof junction therebetween. A power cord extends through at least one of the exterior end caps 44 into the junction box, where the necessary power connections are made to provide power, such as electricity, to the electrical components and circuitry within the housing 12. With reference to FIG. 2, multiple light fixtures 10 of the present invention can be interconnected to one another, such as in series. This is typically done in a daisy-chain configuration. This may be done, for example, by means of a power cord extending between adjacent light fixtures 10 which may be run through a connecting conduit 46 or the like.

Figure 3:
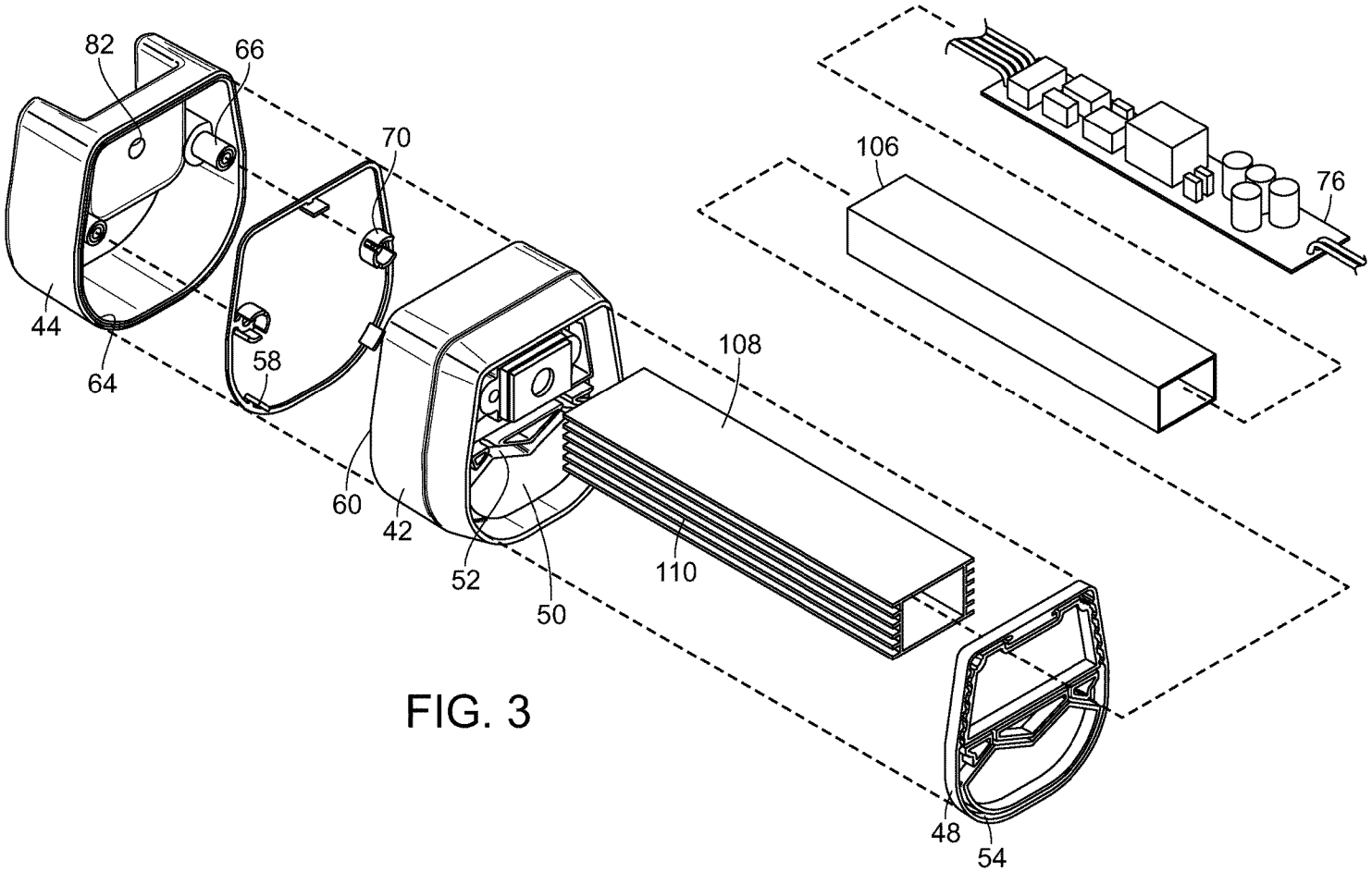
FIG. 3 is an exploded perspective view of exterior and interior end caps, seals, heat sink and electronic circuitry of the light fixture.
Figure 4:
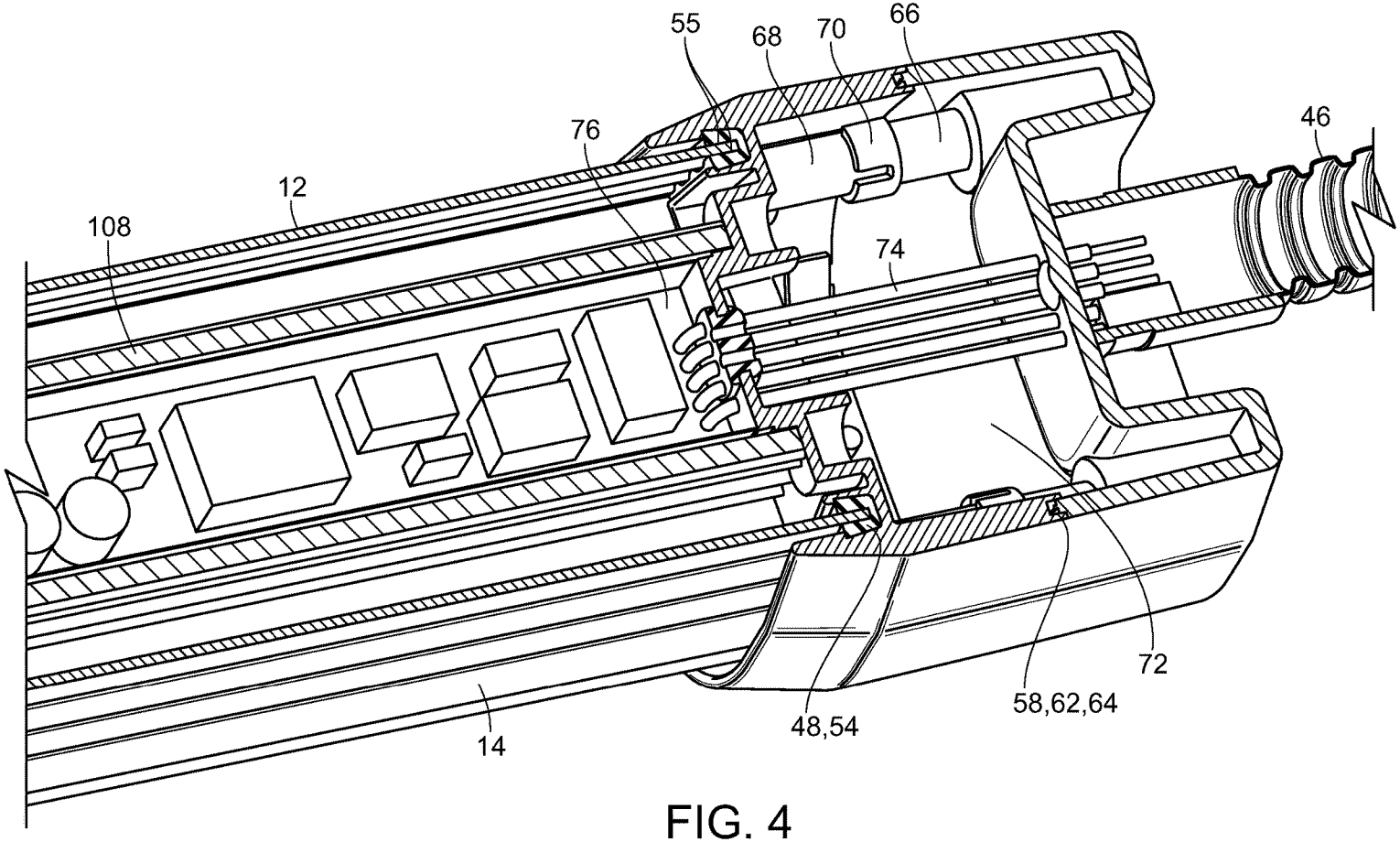
FIG. 4 is a partially sectioned and perspective view of a waterproof junction box formed by the interior and exterior end caps, in accordance with the present invention and electrical connections to electronic circuitry of the light fixture.
Figure 5:
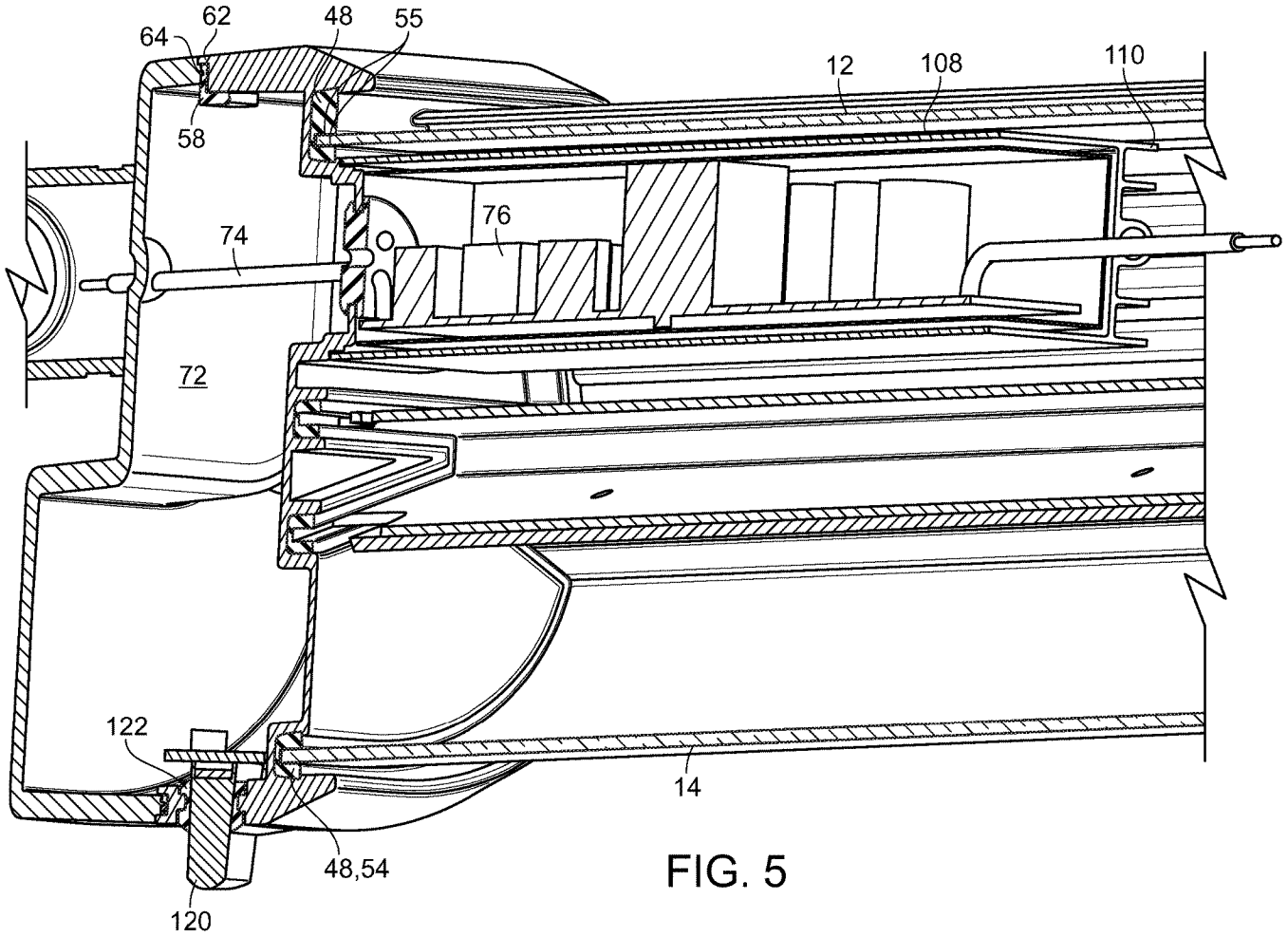
FIG. 5 is a cross-sectional view of a portion of the linear light fixture of the present invention.

With reference now to FIGS. 3-5, a gasket 48 is disposed between the first end of the interior cap 42 and the free end of the housing 12. The gasket 48 has a configuration substantially matching an inner surface configuration of the first end 50 of the interior end cap 42, and more particularly insertable within spaces 52 of structure which corresponds to the free edges of the end of the housing 12. The gasket 48 is comprised of an elastomeric material which defines an open-face groove 54. In a particularly preferred embodiment, the open-face groove 54 is not U-shaped or generally square in cross-sectional configuration, but instead has walls 55 angled or tapered inwardly, such that as the free edges of the housing 12 are inserted within the open-face groove 54, and progressively inserted into the gasket 48, there is an increasing pressure on the negative angles of the gasket such that the inner portion of the open-face groove 54 is expanded outwardly and forms a tight, compressive fit between the free edges 56 of the housing 12 and the corresponding mating spaces 52 formed within the receiving structures of the first end 50 of the interior end cap 42. This creates a waterproof seal of at least IP 67 between the interior end cap 42 and the end of the housing 12.

A second gasket 58 is disposed between the second end 60 of the interior end cap 42 and the exterior end cap 44. In an embodiment of the invention, the second gasket 58 is similar to an O-ring gasket, but having a configuration matching that of the ends of the interior and exterior end caps 42 and 44, such as having a D-shaped configuration. The outer perimeter of the gasket 58 sits within an open-faced recess 62 of the second end 60 of the interior end cap 42 and a peripheral rim 64 of the exterior end cap 44 compresses the gasket 58 into the open-face recess 62 of the interior end cap 42, as shown in FIGS. 4 and 5.

With continuing reference to FIGS. 3-5, the interior end cap 42 and exterior end cap 44 are typically connected to one another by means of fasteners, such as bolts or screws, which are threadedly received into generally aligned connectors 66 and 68 which typically include interior threads for receiving the bolt therein so as to attach the interior and exterior end caps 42 and 44 to one another. The second gasket 58 includes a portion which is insertable between the connectors 66 and 68 and at least partially surrounds the area of connection between the connectors 66 and 68 so that the gasket portion 70 provides a substantially waterproof seal between the connectors 66 and 68. As such, the second gasket 58 provides a waterproof seal between the interior and exterior end caps 42 and 44.

With particular reference now to FIG. 4, the interior and exterior end caps 42 and 44 are configured so as to create a space therebetween defining a junction box 72. The waterproof area forming the junction box 72 enables the power cords 74 to be joined therein, extend to electronic circuit boards and components and the like without fear or risk of water, fluid or other damaging substances coming into contact with the power cords or wires 74 and the electrical connections formed thereby. This arrangement is particularly advantageous when the light fixtures 10 of the present invention are used in demanding environments which require high-pressure wash downs or the electrical connections could otherwise be exposed to water, fluids, and the like.

Figure 6:
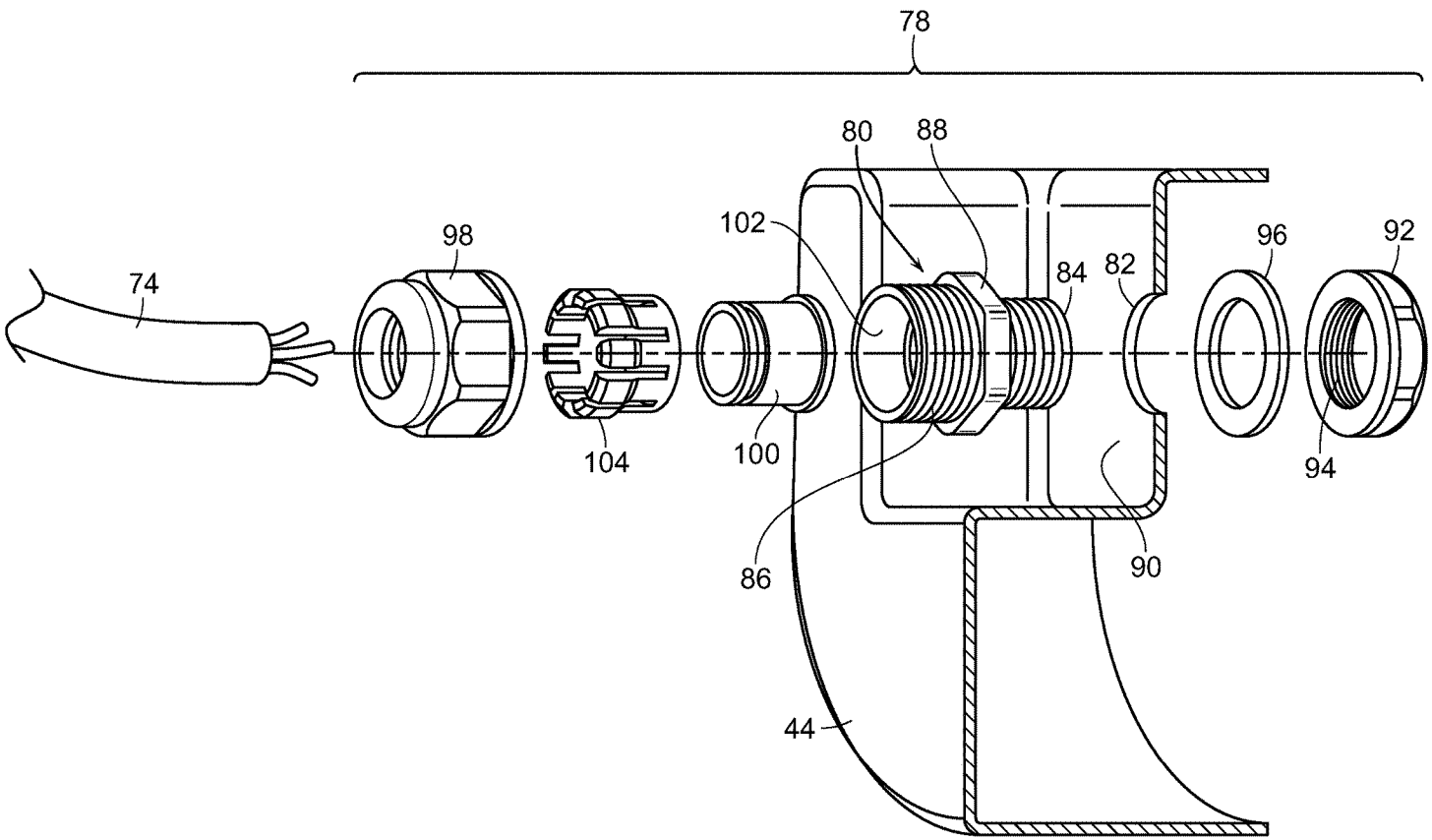
FIG. 6 is an exploded perspective view of a waterproof coupling through which a power cord extends into a junction box of the light fixture, in accordance with the present invention.

With reference now to FIG. 6, the power cord 74 extends through the exterior end cap 44 in a waterproof manner to provide power to the electronic circuitry 76, including the LEDs, within the housing 12. More particularly, the power cord 74 extends through a waterproof coupling 78 which enables the cord to extend through the exterior end cap 44 and into the junction box 72 in a waterproof manner. The coupling 78, as illustrated in FIG. 6, may comprise a hollow junction member 80 having a first end inserted through aperture 82 of the exterior end cap 44. The first and second ends 84 and 86 of the junction include exterior threads. A multi-faceted circumferential projection 88 rests against an exterior wall 90 of the exterior end cap 44. A nut 92 having interior threads 94 is threadedly received onto end 84 of the junction member 80. An elastomeric O-ring or washer 96 is disposed between nut 92 and the junction member 80 so as to provide a waterproof seal therebetween.

An exterior nut 98 is threadedly received onto threaded end 86 of the junction member 80. A waterproof seal is formed therebetween. This may be done, for example, as illustrated in FIG. 6, with a hollow sleeve 100 which extends into chamber 102 of the second end 86 of the junction member 80 and through which the power cord 74 passes through. An elastomeric multi-pronged compression ring 104 is disposed over sleeve 100 and compresses as nut 98 is threadedly attached to end 86 of the junction member 80, causing the sleeve 100 to constrict upon the outer surface of the power cord 74 and form a waterproof seal therebetween.

With reference to FIGS. 3-5, the light fixture assembly 10 of the present invention includes at least one printed circuit board and associated electronic components 76, such as for selectively supplying power to the LEDs. In the illustrated embodiment, the electronic circuitry 76 is disposed within a sleeve 106 and a heat sink 108, which may be disposed within the housing 12. In the illustrated embodiment, the heat sink 108 extends from the interior end cap 42 and into the housing 12. The heat sink 108 may be attached to the interior end cap 42, such as by means of fasteners extending through the end cap 42 and into the heat sink 108. The fasteners may extend into adjacent spaced apart ridges 110, which also serve to conduct heat away from the heat sink 108. The heat sink is typically comprised of a metallic material so as to dissipate heat generated by the electronic circuitry 76 quickly.

The sleeve 106 may have a configuration or be made of a material which give it a spring and biasing qualities so as to securely retain the printed circuit board and associated electronic circuitry 76 therein. The sleeve 106 may also be comprised of a material having insulative properties so as to prevent electrical shorts and the like between the circuitry 76 and the metallic heat sink 108.

Figure 8:
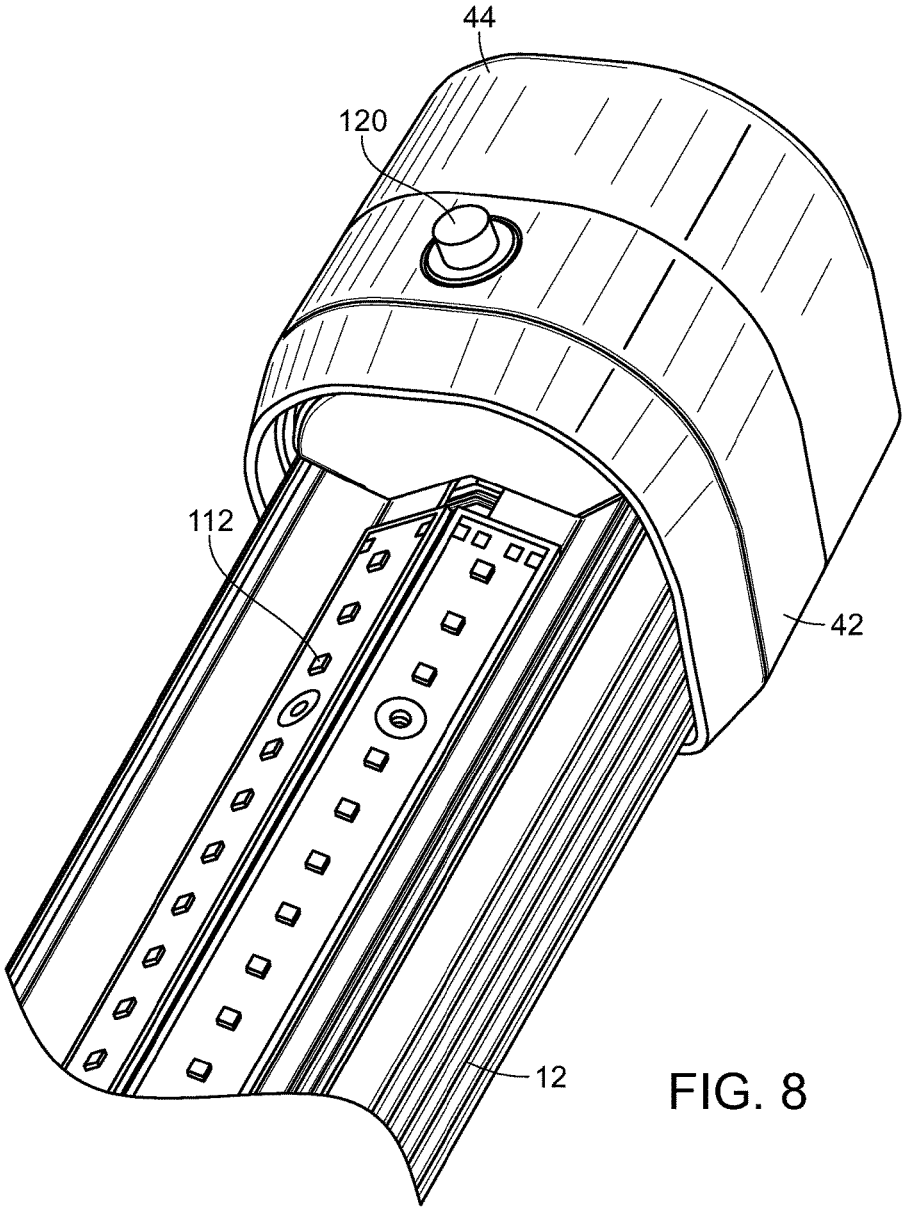
FIG. 8 is a bottom perspective view of the light fixture without the cover, illustrating LED lights mounted on a support member of the housing and a motion sensor of the light fixture.

With reference now to FIGS. 7 and 8, a plurality of LEDs 112 are operably connected to the electronic circuitry 76 and disposed within the housing 12. A sufficient number or type of LEDs are provided so as to provide the necessary light to the area to be illuminated by the light fixture 10 of the present invention. As illustrated, in one embodiment the LEDs 112 are mounted on angled faces of a lower portion of the housing 12 above the cover 14. Preferably, the support members 114 and 116 are angled so as to form V-shaped support members 114 and 116 above the light transmissive cover 14 so that the LEDs 112 are angled at a non-normal angle, such as between zero and ninety degrees so as to direct light at diverging angles so as to substantially illuminate the area below the light fixture 10. The housing 12 may be comprised of a material, such as aluminum or the like, which can readily dissipate heat. Moreover, preferably an air channel passageway 118 is defined at least in part by the V-shaped mount surfaces 114 and 116 so as to provide heat dissipation into the air within the channel 118. Such an arrangement can keep the LEDs 112 cool and extend their operating life.

With reference to FIGS. 5 and 8, the light fixture 10 of the present invention may include a motion sensor 120 for detecting motion in an area below or surrounding the light fixture 10. The motion sensor 120 can serve as an automatic switch which will supply power to the LEDs so that they are illuminated when there is motion in the area surrounding the light 10 and can automatically turn off the light when motion is not detected for a predetermined amount of time. As such, the motion sensor 120 is operably connected to the LEDs, such as via circuitry 76. The motion sensor 120 has a waterproof seal so as to prevent water from entering in the junction where the motion sensor 120 extends from the light. This may include, for example, an elastomeric gasket 122 disposed between the motion sensor 120 and the light, typically the junction box formed by the interior end cap 42 or exterior end cap 44. In this manner, electrical wiring extending between the motion sensor 120 and the electronic circuitry 76 is within a waterproof sealed area. Other non-external smart controls can be incorporated into the plastic junction box as necessary.

Although several embodiments have been described in detail for purposes of illustration, various modifications may be made without departing from the scope and spirit of the invention. Accordingly, the invention is not to be limited, except as by the appended claims.

What is claimed is:

1. A linear LED light, comprising:

an elongated housing having a plurality of LEDs and a light transmissive cover;

an interior end cap having a first end attached to an end of the housing;

a first gasket providing a waterproof seal between the first end of the interior end cap and the housing;

an exterior end cap attached to a second end of the interior end cap, the interior end cap and the exterior end cap cooperatively forming a junction box therebetween;

a second gasket providing a waterproof seal between the second end of the interior end cap and the exterior end cap;

a power cord extending through the exterior end cap in a waterproof manner and providing power to the LEDs within the housing.

2. The light of claim 1, wherein the first gasket comprises an open-faced groove that receives the end of the housing therein.

3. The light of claim 2, wherein the open-faced groove is defined by elastomeric walls having an inward taper.

4. The light of claim 1, including a heat sink supporting LED electronic circuitry components extending from the interior end cap into the housing.

5. The light of claim 1, including a motion sensor operably coupled to the LEDs.

6. The light of claim 5, wherein the motion sensor has a waterproof seal with the junction box.

7. The light of claim 1, wherein the housing defines a V-shaped LED support member above the light transmissive cover.

8. The light of claim 1, including a waterproof coupling through which the electrical power cord extends through the exterior end cap and into the junction box.

9. The light of claim 1, wherein the housing includes an attachment rail extending along a length of an upper surface thereof.

10. The light of claim 9, including an expandable attachment bracket removably coupled to the rail.

11. The light of claim 1 connected in a daisy-chain configuration with another linear LED light.

12. A linear LED light, comprising:

an elongated housing having a plurality of LEDs and a light transmissive cover;

an interior end cap having a first end attached to an end of the housing;

a first gasket providing a waterproof seal between the first end of the interior end cap and the housing;

an exterior end cap attached to a second end of the interior end cap, the interior end cap and the exterior end cap cooperatively forming a junction box therebetween;

a second gasket providing a waterproof seal between the second end of the interior end cap and the exterior end cap;

a power cord extending through the exterior end cap in a waterproof manner and providing power to the LEDs within the housing;

a waterproof coupling through which the power cord extends through the exterior end cap and into the junction box;

wherein the first gasket comprises an open-faced groove that receives the end of the housing therein; and wherein the open-faced groove is defined by elastomeric walls having an inward taper.

13. The light of claim 12, including a heat sink supporting LED electronic circuitry components extending from the interior end cap into the housing.

14. The light of claim 12, including a motion sensor operably coupled to the LEDs.

15. The light of claim 14, wherein the motion sensor has a waterproof seal with the junction box.

16. The light of claim 12, wherein the housing defines a V-shaped LED support member above the light transmissive cover.

17. The light of claim 12, wherein the housing includes an attachment rail extending along a length of an upper surface thereof.

18. The light of claim 17, including an expandable attachment bracket removably coupled to the rail.

19. The light of claim 12 connected in a daisy-chain configuration with another linear LED light.

* * * * *